US008167664B2

(12) United States Patent
Ju

(10) Patent No.: US 8,167,664 B2
(45) Date of Patent: May 1, 2012

(54) RECEPTACLE CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 52 days.

(21) Appl. No.: 12/951,631

(22) Filed: Nov. 22, 2010

(65) Prior Publication Data

US 2011/0318973 A1 Dec. 29, 2011

(30) Foreign Application Priority Data

Jun. 24, 2010 (CN) ..... 2010 2 0242369 U

(51) Int. Cl.
*H01R 13/40* (2006.01)

(52) U.S. Cl. ..... 439/733.1

(58) Field of Classification Search ..... 439/733.1, 439/747, 342, 856, 857
See application file for complete search history.

(56) References Cited

U.S. PATENT DOCUMENTS 4,379,611 A * 4/1983 Foege et al. ..... 439/747
5,252,097 A * 10/1993 Lindeberg et al. ..... 439/856
6,319,038 B1 * 11/2001 Howell et al. ..... 439/342
6,908,328 B2 * 6/2005 Lei et al. ..... 439/342
7,303,421 B2 * 12/2007 Liao ..... 439/342
7,517,240 B2 * 4/2009 Ma ..... 439/342
7,601,036 B2 * 10/2009 Cheng et al. ..... 439/857
7,670,167 B2 * 3/2010 Pandey et al. ..... 439/342
2003/0199210 A1 * 10/2003 Chang ..... 439/857

* cited by examiner

*Primary Examiner* — Alexander Gilman
(74) *Attorney, Agent, or Firm* — Morris Manning & Martin LLP; Tim Tingkang Xia, Esq.

(57) ABSTRACT

A receptacle connector includes a body; a conductive member received in the body and having a bottom, in which a soldering portion extends from the bottom, the bottom is bent upwards to form a base, an angle is formed between the planes of the base and the bottom, two opposing sides of the base are bent to form a first arm and a second arm, the first and second arms are on the same side and are in the same direction as a bending direction of the base, the first arm has a first contact portion, and the second arm has a second contact portion; and a third arm extending from one end of the base away from the bottom, inclined towards the first and second arms, in which the inclination of the third arm does not exceed initial contact positions of the first and second arms with a pin, the third arm has a third contact portion, and the first, second and third contact portions are used for jointly retaining and contacting the pin.

12 Claims, 5 Drawing Sheets

RECEPTACLE CONNECTOR

CROSS-REFERENCE TO RELATED PATENT APPLICATION

This non-provisional application claims benefits and priority under 35 U.S.C. §119(a) on Chinese Patent Application No. 201020242369.0 filed in The People's Republic of China on Jun. 24, 2010, which is incorporated herein by reference in its entirety.

Some references, if any, which may include patents, patent applications and various publications, are cited in a reference list and discussed in the description of this invention. The citation and/or discussion of such references is provided merely to clarify the description of the present invention and is not an admission that any such reference is "prior art" to the invention described herein. All references, if any, listed, cited and/or discussed in this specification are incorporated herein by reference in their entireties and to the same extent as if each reference was individually incorporated by reference.

BACKGROUND OF THE PRESENT INVENTION

1. Field of the Invention

The present invention relates to a receptacle connector, and more particularly to a zero insertion force receptacle connector.

2. Description of the Related Art

Chinese Patent No. CN200520005867 discloses a zero insertion force receptacle connector. The receptacle connector is provided with a conductive member, and the conductive member has a body, a soldering portion perpendicularly bent from one end of the body, and a first arm and a second arm perpendicularly bent from two opposing sides of the body and substantially extending in the same direction. The body includes a base connected to the soldering portion and a third contact portion bent from the other end of the base, in which an elastic displacement exists between the third contact portion and the base. Since the base abuts against a wall of a conductive member receiving housing, an elastic displacement also exists between a free end of the third contact portion and the wall of the conductive member receiving housing. When a pin is pushed to abut against the third contact portion, the third contact portion may undergo enough elastic deformation correspondingly, so as to further closely contact the inserted pin.

However, the following deficiencies exist when the conductive member of the receptacle connector is in close contact with the pin.

1. Since the base is located at the upper part of the conductive member, and the third contact portion is bent at the junction between the third contact portion and the base, the arm of force of the third contact portion is too short, and as the number of times of inserting and removing the pin increases, the third contact portion inevitably undergoes permanent deformation after a long time, which further influences the electrical connection of the pin and the conductive member.

2. The conductive member structure of an ordinary receptacle connector is short, and if the limited upper part of the conductive member is bent, it is difficult to place a jig, which makes it rather difficult to bend and complicates operation, and meanwhile the elastic deformation is limited.

Therefore, a heretofore unaddressed need exists in the art to address the aforementioned deficiencies and inadequacies.

SUMMARY OF THE PRESENT INVENTION

Accordingly, in one aspect, the present invention is directed to a receptacle connector, in which a conductive member of the receptacle connector has a third arm for preventing permanent deformation of the conductive member and providing enough elasticity when the conductive member contacts an inserted pin.

The present invention in another aspect is also directed to a receptacle connector which is easy to bend and provides a three-point contact of the pin.

In one embodiment, the present invention adopts the following inventive measures and provides a receptacle connector that includes: a body; a conductive member, received in the body and having a bottom, in which a soldering portion extends from the bottom, the bottom is bent upwards to form a base, an angle is formed between the planes of the base and the bottom, two opposing sides of the base are bent to form a first arm and a second arm, the first arm and the second arm are on the same side and are in the same direction as a bending direction of the base, the first arm has a first contact portion, and the second arm has a second contact portion; and a third arm extending from one end of the base away from the bottom, inclined towards the first arm and the second arm, in which the inclination of the third arm does not exceed initial contact positions of the first arm and the second arm with the pin, the third arm has a third contact portion, and the first contact portion, the second contact portion and the third contact portion are used for jointly retaining and contacting the pin.

Furthermore, the first arm has a first body, one end of the first body is connected to the bottom and the other end extends to form a first connecting portion, and the first connecting portion is connected to the first contact portion; the second arm has a second body symmetrical with the first body, and extends to form a second connecting portion symmetrical with the first connecting portion, and the second connecting portion is connected to the second contact portion.

Through the above inventive features as disclosed in various embodiments, the receptacle connector of the present invention has the following advantages.

The distance between the third contact portion and the bottom is long enough, and the third contact portion is inclined and bent from the bottom, so that when the pin is inserted, the longer arm of force of the third contact portion reduces the force required for inserting the pin, and provides better elasticity to ensure a real three-point contact between the receptacle connector and the pin, thereby achieving a stable electrical connection. Meanwhile, the probability of permanent deformation of the third arm as the number of times of inserting and removing the pin increases is reduced.

These and other aspects of the present invention will become apparent from the following description of the preferred embodiment taken in conjunction with the following drawings and their captions, although variations and modifications therein may be affected without departing from the spirit and scope of the novel concepts of the disclosure.

BRIEF DESCRIPTION OF THE DRAWINGS

The drawings described below are for illustration purposes only. The drawings are not intended to limit the scope of the present teachings in any way.

DETAILED DESCRIPTION OF THE PRESENT INVENTION

Figure 1:
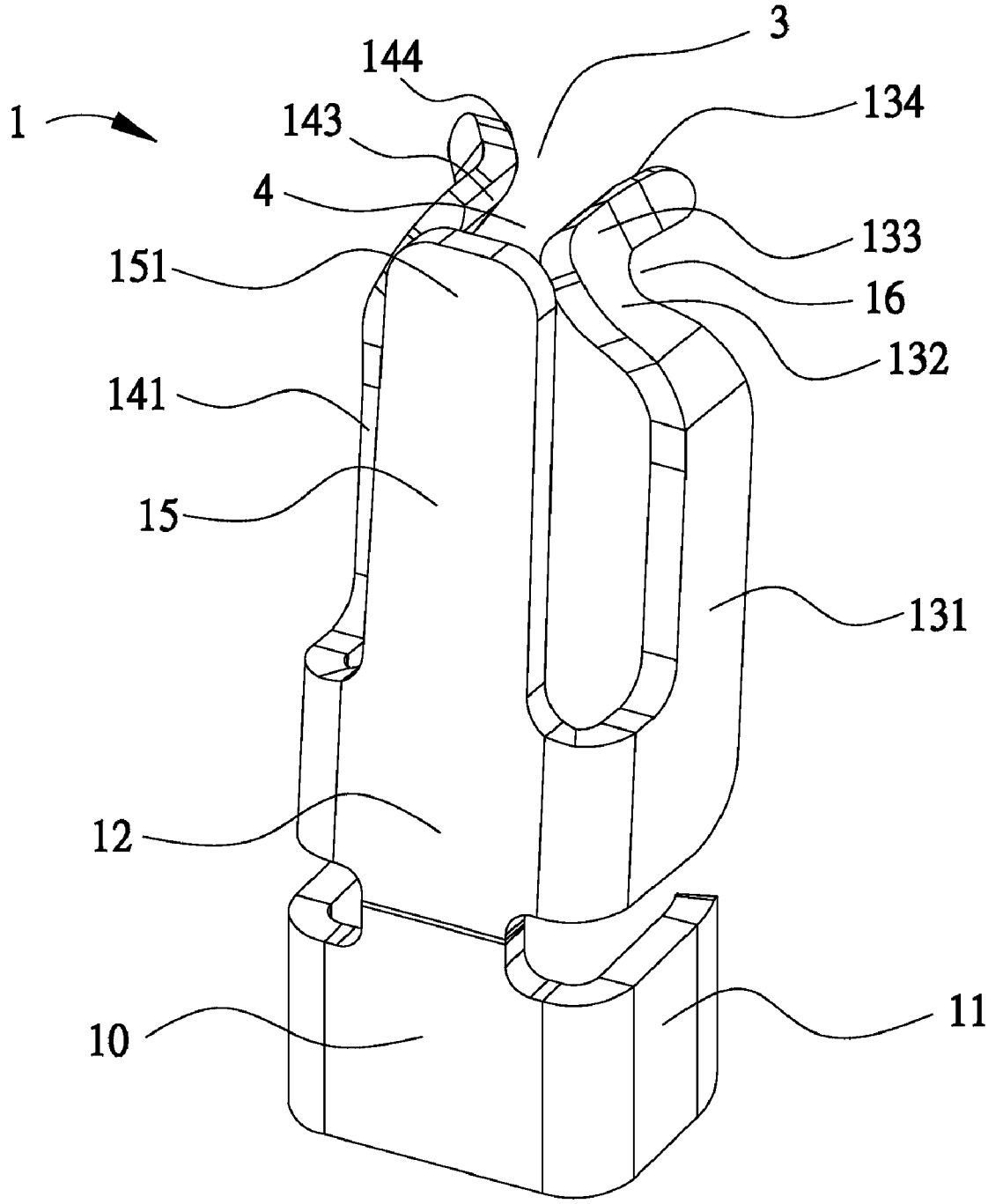
FIG. 1 is a three-dimensional view of a conductive member of a receptacle connector according to one embodiment of the present invention.
Figure 2:
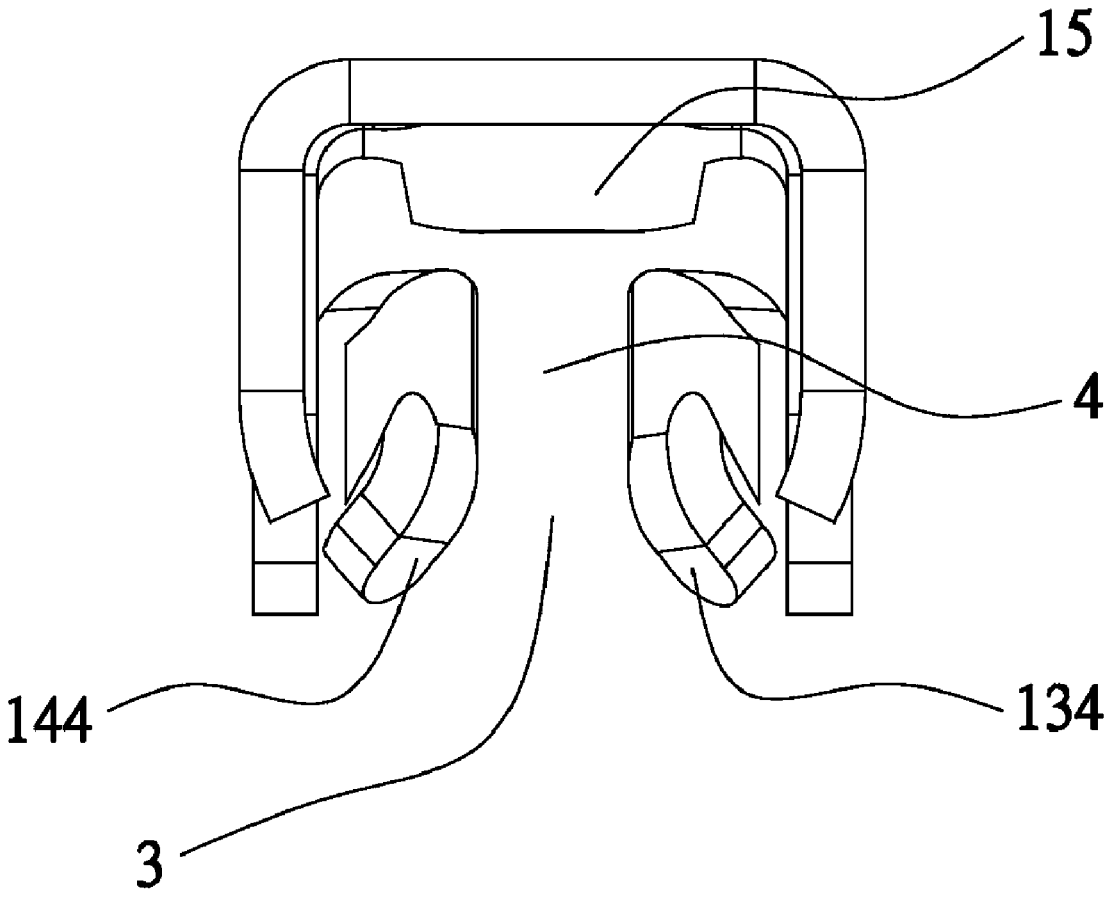
FIG. 2 is a top view of the conductive member of the receptacle connector according to one embodiment of the present invention.
Figure 3:
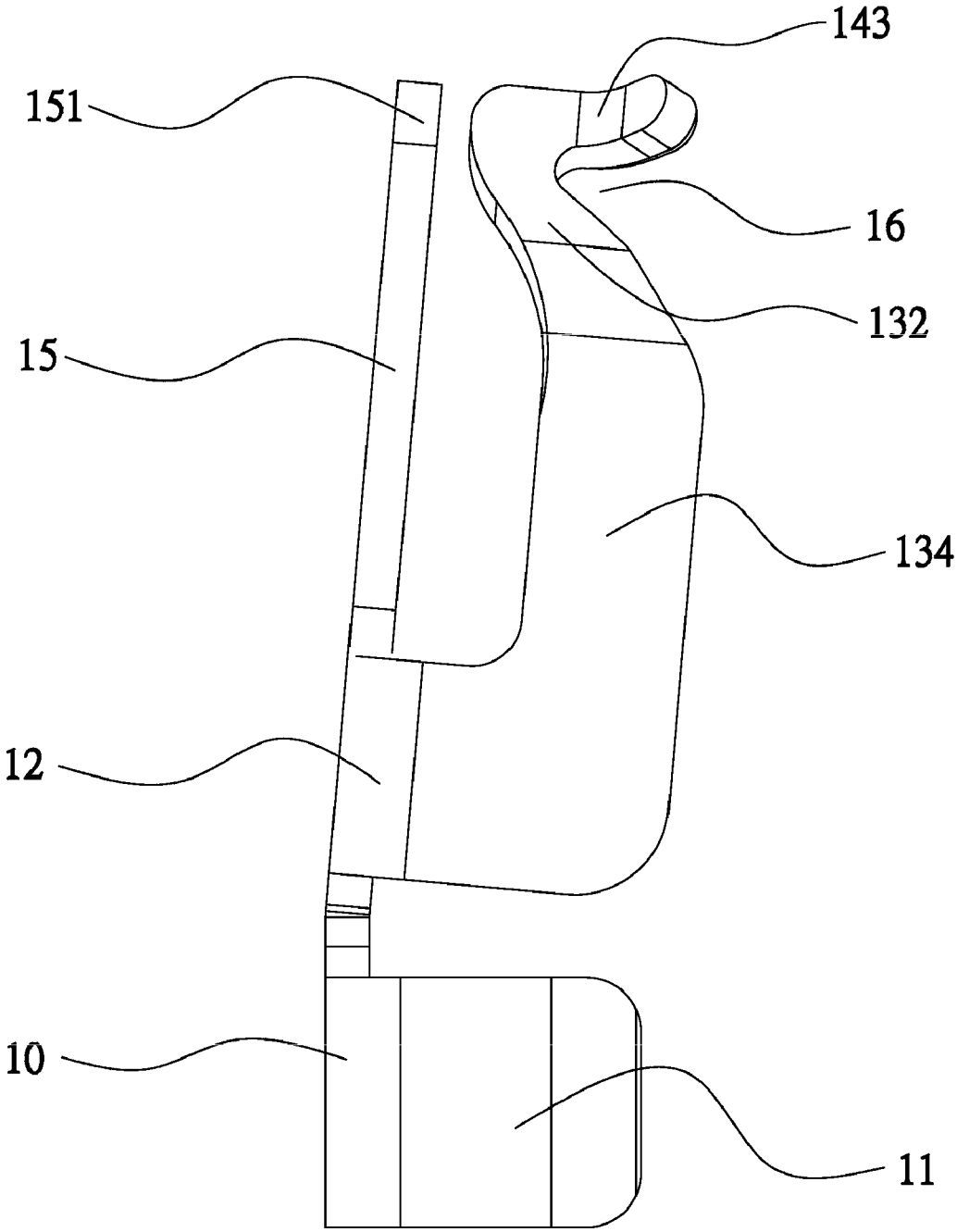
FIG. 3 is a left view of the conductive member of the receptacle connector according to one embodiment of the present invention.
Figure 4:
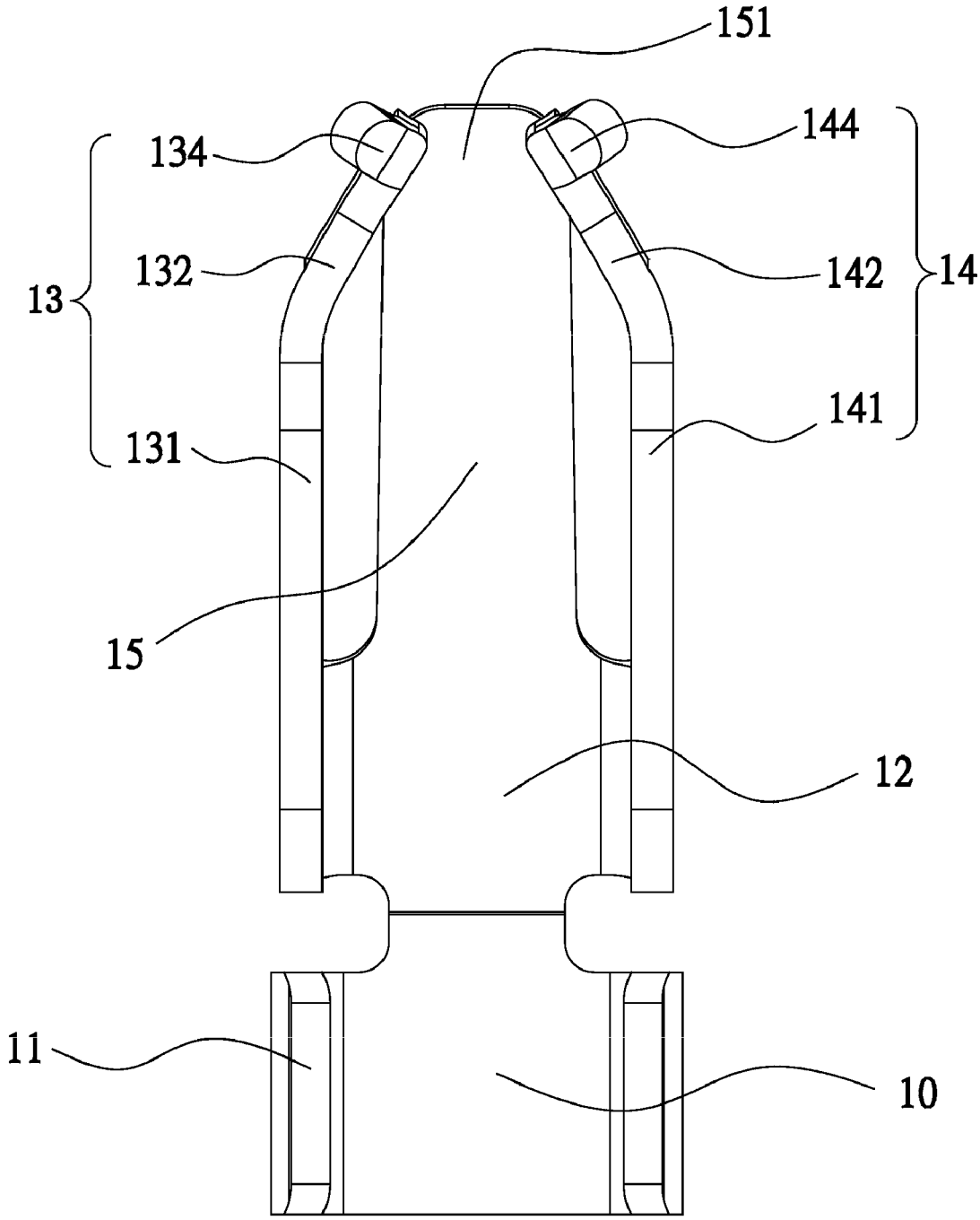
FIG. 4 is a front view of the conductive member of the receptacle connector according to one embodiment of the present invention.
Figure 5:
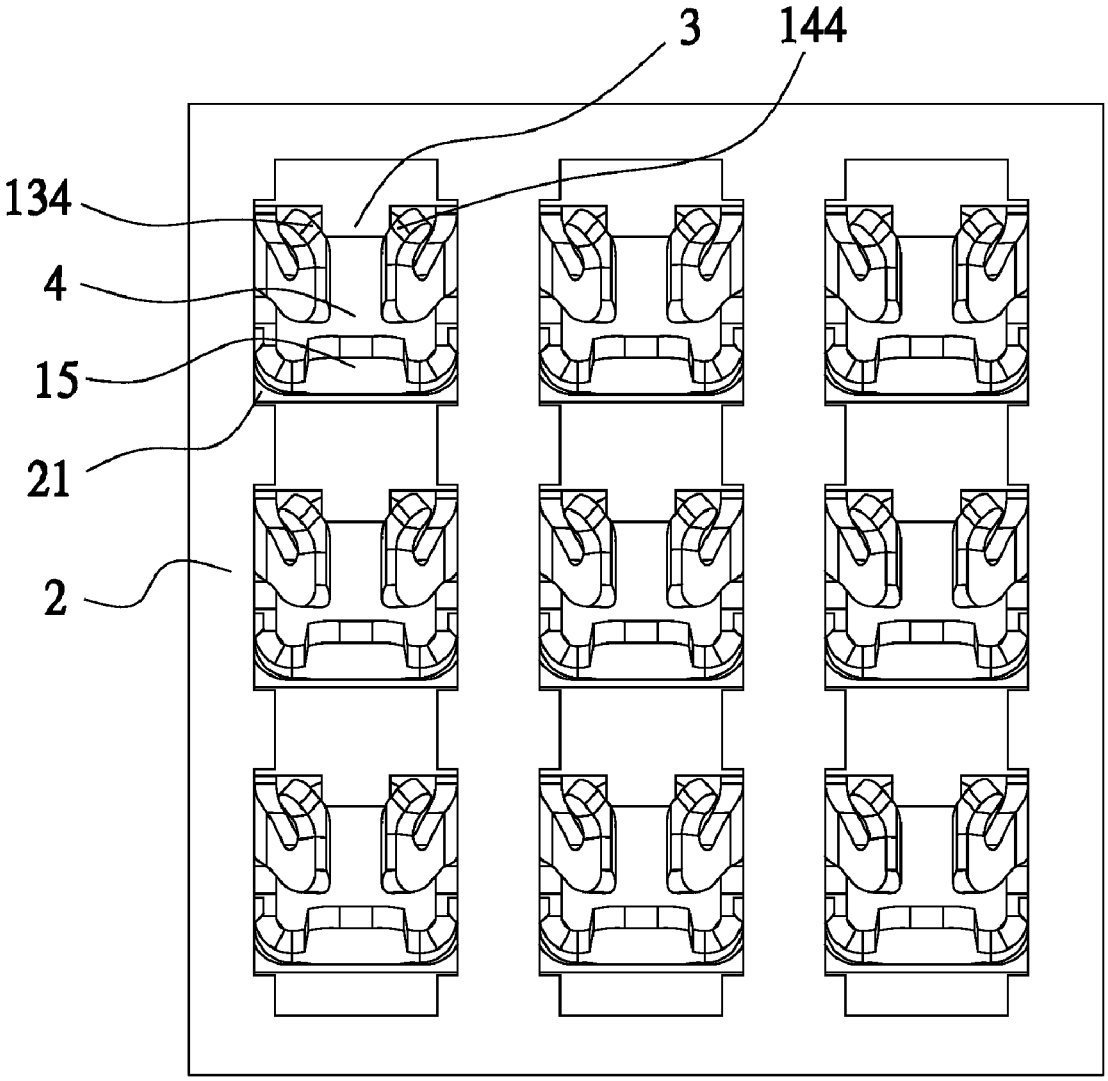
FIG. 5 is a top view of the conductive member of the receptacle connector received in a corresponding receiving housing according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, FIGS. 1-5, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention. Additionally, some terms used in this specification are more specifically defined below.

DEFINITIONS

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

A list of reference numerals with corresponding components as shown in the drawings is given below only for the purpose of a reader's convenience:

Conductive member 1
Bottom 10
Soldering portion 11
Base 12
First arm 13
First body 131
First connecting portion 132
First contact portion 133
First guide portion 134
Second arm 14
Second body 141
Second connecting portion 142
Second contact portion 143
Second guide portion 144
Third arm 15
Third contact portion 151
First notch 16
Second notch 17
Body 2
Receiving housing 21
Guiding space 3
Retaining space 4.

Referring now to FIGS. 1 to 5, in a preferred embodiment of the present invention, a receptacle connector includes a conductive member 1, and is used for electrically connecting to an inserted pin of a mating device (not shown). The receptacle connector further includes a body 2. The conductive member 1 is received in a receiving housing 21 opened in the body 2. The conductive member 1 has a bottom 10, one end of the bottom 10 extends to form a soldering portion 11 and the other end of the bottom 10 extends to form a base 12. Two opposing sides of the base 12 extend to form a first arm 13 and a second arm 14. The first arm 13 and the second arm 14 are on the same side and are in the same direction as a bending direction of the base 12. One end of the base 12 away from the bottom 10 further extends to form a third arm 15. The third arm 15 is in a plate shape, and the inclination of the third arm 15 is preferably such that the third arm 15 does not contact positions of the first arm 13 and the second arm 14 that are closest to the third arm 15. The height of the third arm 15 is substantially the same as that of the first arm 13 and the second arm 14, and the third arm 15 has a third contact portion 151.

The first arm 13 has a first body 131. The first body 131 extends out through the base 12, the plane of the first body 131 is substantially perpendicular to that of the third arm 15, and the first body 131 extends upwards to form a first connecting portion 132. The first connecting portion 132 is bent inwards and is connected to a first contact portion 133, and the first contact portion 133 is in contact with the pin. Meanwhile, the first contact portion 133 is provided with a first guide portion 134 at a front end thereof, for guiding the pin into contact with the first contact portion 133.

The second arm 14 and the first arm 13 have the same size and shape and are symmetrical to each other. The second arm 14 has a second body 141. The second body 141 extends out through the base 12, the plane of the second body 141 is substantially perpendicular to that of the third arm 15, and the second body 141 extends upwards to form a second connecting portion 142. The second connecting portion 142 is bent inwards and is connected to a second contact portion 143, and the second contact portion 143 is in contact with the pin. Meanwhile, the second contact portion 143 is provided with a second guide portion 144 at a front end thereof, for guiding the pin into contact with the second contact portion 143.

The first guide portion 134 and the second guide portion 144 define a wide guiding space 3, and a minimal width of the guiding space 3 is greater than a diameter of the inserted pin. A first notch 16 is provided between the first contact portion 133 and the first connecting portion 132, and a second notch 17 is provided between the second contact portion 143 and the second connecting portion 142. The first notch 16 and the second notch 17 reduce the strength at the conductive member 1, thereby facilitating elastic deformation of the first contact portion 133 and the second contact portion 143 when the pin is inserted.

The first contact portion 133, the second contact portion 143 and third contact portion 151 define a retaining space 4 therebetween, and are used for jointly retaining and contacting the pin.

When the pin is inserted into the receptacle connector, the pin firstly passes through the first guide portion 134 and the second guide portion 144 to enter the guiding space 3, and then is driven by a driving component (not shown) to enter the retaining space 4 from the guiding space 3. The pin firstly contacts the first contact portion 133 and the second contact portion 143 and finally is pushed to contact the first contact portion 133, the second contact portion 143 and the third contact portion 151 at the same time, thereby achieving a stable electrical connection.

Accordingly, among other things, the receptacle connector(s) of the present invention has the following advantages over the prior art.

1. As compared with the receptacle connector in the prior art, in one embodiment of the present invention, the distance between the third contact portion and the bottom is long enough, and the third contact portion is inclined and bent from the bottom, so that when the pin is inserted, the longer arm of force of the third contact portion reduces the force required for inserting the pin, and provides better elasticity to ensure a real three-point contact between the receptacle connector and the pin, thereby achieving a stable electrical connection. Meanwhile, the probability of permanent deformation of the third arm as the number of times of inserting and removing the pin increases is reduced.

2. When the conductive member structure is short, since the conductive member of the receptacle connector is bent at the bottom, it is convenient to place a jig and bending can be completed more conveniently and rapidly.

3. The first notch and the second notch reduce the strength at the conductive member, thereby facilitating elastic deformation of the first contact portion and the second contact portion when the pin is inserted.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A receptacle connector, for contacting an inserted pin of a mating device, comprising:

a body;

a conductive member, received in the body and having a bottom, wherein a soldering portion extends from the bottom, the bottom is bent upwards to form a base, an angle is formed between the planes of the base and the bottom, two opposing sides of the base are bent to form a first arm and a second arm, the first arm and the second arm are on the same side and are in the same direction as a bending direction of the base, the first arm has a first contact portion, and the second arm has a second contact portion; and a third arm extending from one end of the base away from the bottom, inclined towards the first arm and the second arm, wherein the inclination of the third arm does not exceed initial contact positions of the first arm and the second arm with the pin, the third arm has a third contact portion, and the first contact portion, the second contact portion and the third contact portion are used for jointly retaining and contacting the pin.

2. The receptacle connector according to claim 1, wherein the first arm has a first body, one end of the first body is connected to the base and the other end extends to form a first connecting portion, and the first connecting portion is connected to the first contact portion; the second arm has a second body symmetrical with the first body, and extends to form a second connecting portion symmetrical with the first connecting portion, and the second connecting portion is connected to the second contact portion.

3. The receptacle connector according to claim 2, wherein the first connecting portion and the second connecting portion are bent relatively inwards.

4. The receptacle connector according to claim 2, wherein the second contact portion is symmetrical with the first contact portion.

5. The receptacle connector according to claim 2, wherein the first contact portion is provided with a first guide portion, and the second contact portion is provided with a second guide portion symmetrical with the first guide portion.

6. The receptacle connector according to claim 5, wherein the first guide portion and the second guide portion define a wide guiding space, and a minimal width of the guiding space is greater than a diameter of the inserted pin.

7. The receptacle connector according to claim 2, wherein a first notch is provided between the first contact portion and the first connecting portion, and a second notch is provided between the second contact portion and the second connecting portion.

8. The receptacle connector according to claim 1, wherein the first contact portion and the second contact portion define a retaining space.

9. The receptacle connector according to claim 1, wherein the third contact portion is substantially in the same plane as the first contact portion and the second contact portion.

10. The receptacle connector according to claim 1, wherein the base is in interference fit with an inner wall of a receiving housing of the body, so as to fix the conductive member.

11. The receptacle connector according to claim 1, wherein the third arm is not in contact with the first arm and the second arm.

12. The receptacle connector according to claim 1, wherein the third arm does not extend to between the first arm and the second arm.

* * * * *